United States Patent [19]

Kasahara et al.

[11] 4,314,517

[45] Feb. 9, 1982

[54] SEWING MACHINE WITH SUPPLEMENTAL WORK SUPPORTING SURFACE

[75] Inventors: Takahiko Kasahara, Anjoshi; Tukasa Yamaguchi, Aichiken; Shigeharu Shichi, Anjoshi; Masayuki Kato, Owariasahishi; Senji Suito, Kariyashi, all of Japan

[73] Assignee: Aisin Seiki Kabushiki Kaisha, Kariyashi, Japan

[21] Appl. No.: 2,003

[22] Filed: Jan. 9, 1979

[30] Foreign Application Priority Data

Jan. 13, 1978 [JP] Japan ..... 53-532472[U]

[51] Int. Cl.[3] ..... D05B 73/10

[52] U.S. Cl. ..... 112/260; 108/26

[58] Field of Search ..... 112/260, 13, 258, 217.1; 108/26; 312/208, 308

[56] References Cited

U.S. PATENT DOCUMENTS

| | | | |
|---|---|---|---|
| 2,398,697 | 4/1946 | Colegrove | 112/260 |
| 2,424,872 | 7/1947 | Zonis | 112/260 |
| 2,464,838 | 3/1949 | Adler | 112/260 |
| 2,945,461 | 7/1960 | Perla | 112/260 |
| 3,344,762 | 10/1967 | Szostak et al. | 112/260 |
| 4,040,369 | 8/1977 | Kaito | 112/258 |
| 4,114,548 | 9/1978 | Kasahara et al. | 112/258 |

*Primary Examiner*—Werner H. Schroeder
*Assistant Examiner*—Andrew M. Falik
*Attorney, Agent, or Firm*—Oblon, Fisher, Spivak, McClelland & Maier

[57] ABSTRACT

This invention concerns a sewing machine of the kind in which a main base and a supplemental base are provided. The supplemental base is connected to the main base through link mechanisms so as to be either contiguously positioned with respect to the main base or spaced therefrom so as to present a narrower support surface conducive to supporting a tubular fabric.

3 Claims, 4 Drawing Figures

SEWING MACHINE WITH SUPPLEMENTAL WORK SUPPORTING SURFACE

BACKGROUND OF THE INVENTION

1. Field of the Invention

This invention relates to a sewing machine of a type in which the base is enabled by manupulation to remain in a mode adapted to provide a wide flat plane on which is supported an ordinary flat fabric or to be placed in another mode adapted to provide a narrower or smaller plane around which a tubular form fabric is positioned.

2. Description of the Prior Art

In some of the prior art sewing machines of this type, an extra or supplemental base was provided separately detachable from the sewing machine head. This arrangement was found to be inconvenient for the operator when either altering the sewing operation from a flat to a tubular fabric or storing the machine in its portable case. In addition, the supplemental base when separated from the main base necessitated a larger space in storage with the added possibility of its being lost.

SUMMARY OF THE INVENTION

A principle object of the present invention therefore is to provide a sewing machine which avoids the drawbacks of the prior art sewing machine briefly outlined above by pivotally mounting the supplemental base on the base of a head with the convenient capability of changing the mode of operation from flat to tubular fabric sewing and with the added capability of using an unused area for storing ordinary tools for maintenance of the sewing machine.

Accordingly, the embodiment of the invention includes a main base, a head extending from the base thereover, a needle plate associated with the base for supporting fabric in position to be stitched, and a supplemental base connected to the main base through means of link mechanisms so as to be placed in a position in which the supplemental base is substantially in a plane including the main base and is immediately contiguous to the main base or in another position in which the supplemental base is separated from the main base a distance sufficient to allow a tubular work fabric to be supported around the main base.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DESCRIPTION OF THE PREFERRED EMBODIMENT

Figure 1:
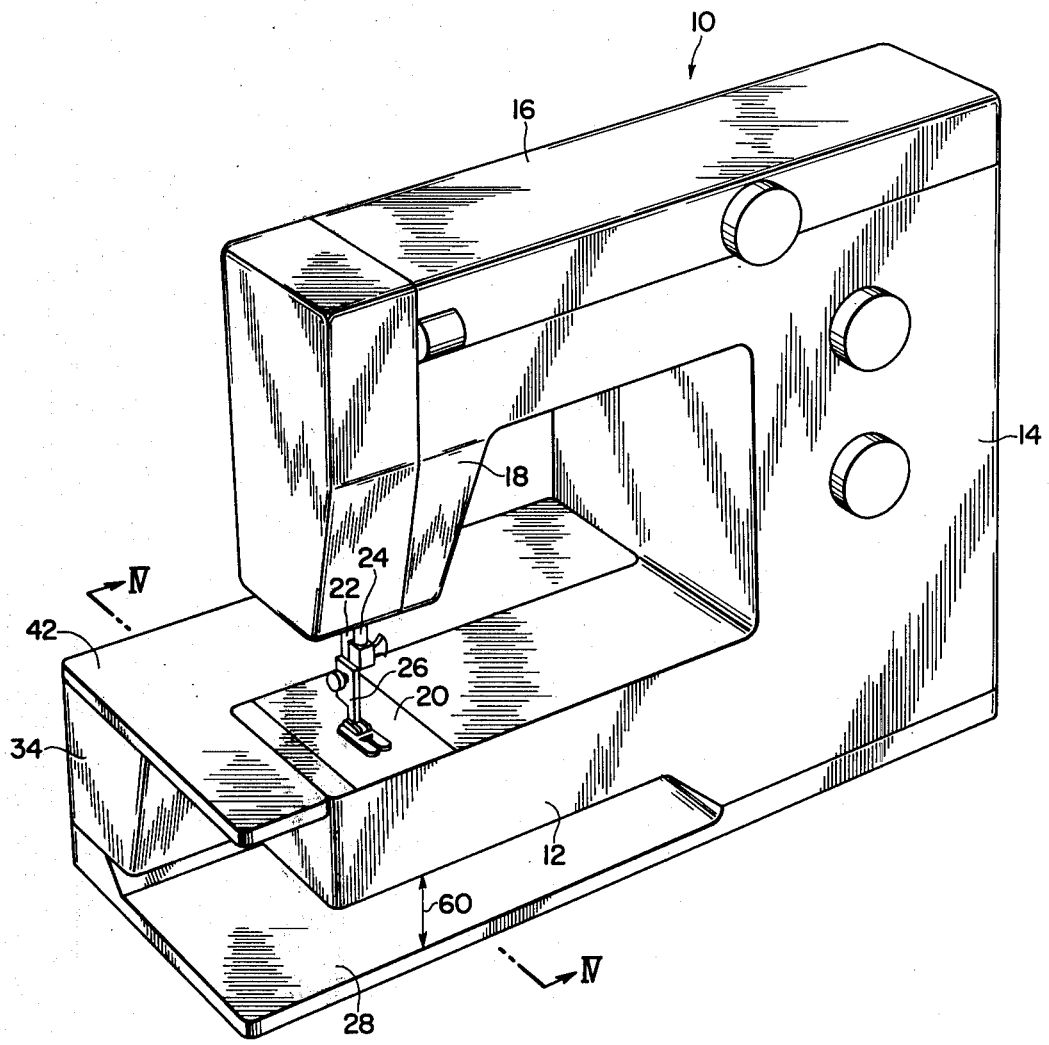
FIG. 1 is a perspective view of a sewing machine head according to the invention.

The sewing machine of the present invention may include a main base 12 having the usual hollow upright bracket 14 extending upwardly therfrom, the hollow arm 16 extending, in a substantially conventional manner over base 12 to present the usual front bearing upright 18 immediately over needle plate 20 provided in base 12. Upright 18 may provide bores or other suitable guides in which may slide presser foot bar 22 and needle bar 24. A shaft (not shown) may be positioned in arm 16 from which, by suitable mechanisms, reciprocating motion is imparted to needle bar 24. Reference numeral 26 represents a conventional presser foot to resiliently press fabric (not shown) which may have been positioned upon the needle plate 20.

Figure 3:
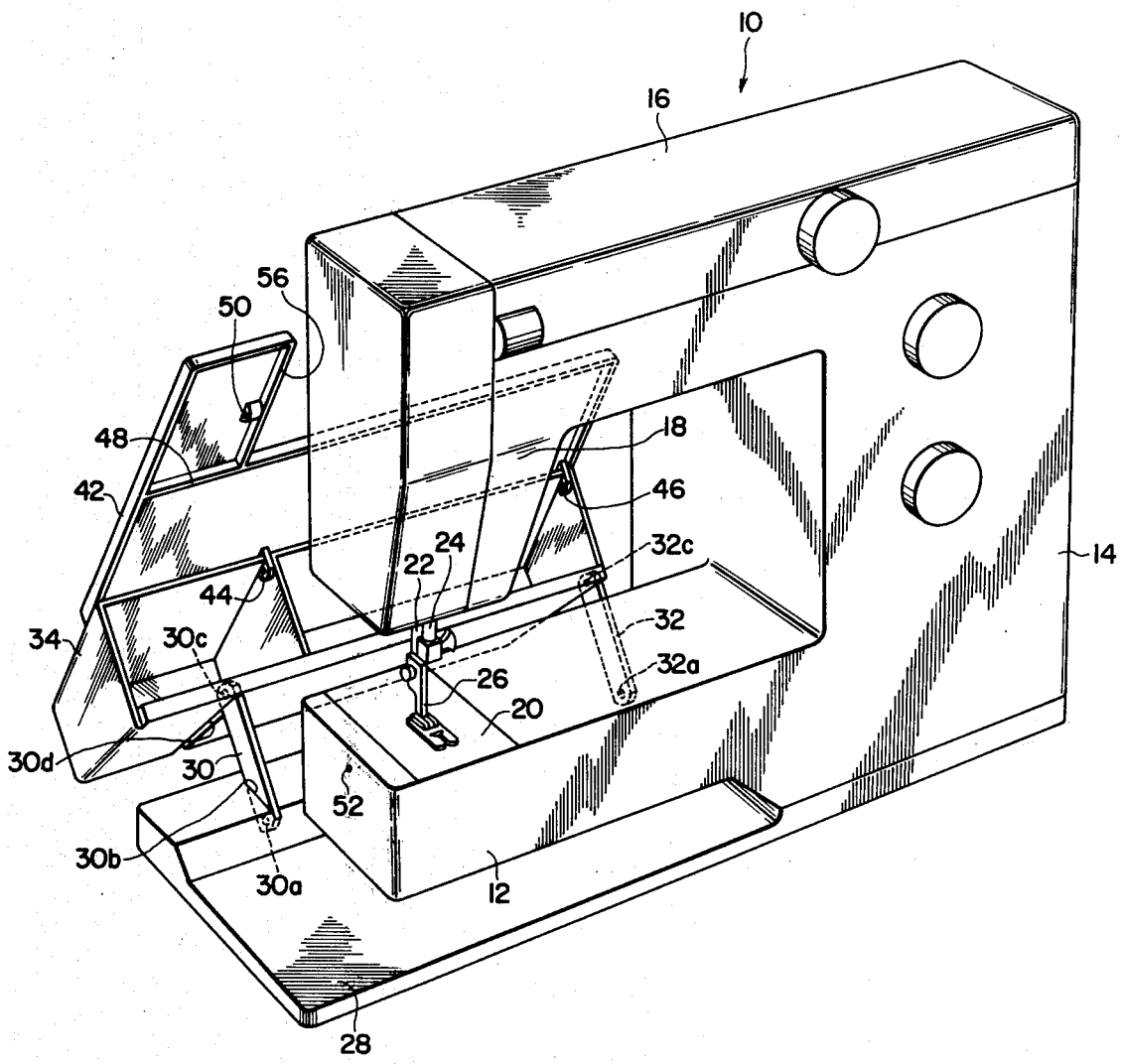
FIG. 3 is a similar view to that of FIG. 2 showing an internal space of a part of the sewing machine head.

A flat bottom plate 28 is fastened by means of, for example, bolts (not shown) to the main base 12 and extends under the base 12 to define a clearance 60 between the base 12 and the bottom plate 28. As shown in FIG. 3, a pair of link members 30 and 32 are pivotally mounted at their lower end sections on pins **30*a* and 32*a*, respectively. Links 30 and 32 are of identical length and the pins 30*a* and 32*a* are in alignment with each other. As will be seen in FIG. 4, link 30 has the foot thereof to cooperate with a groove or slit 30*b* the bottom of which is inclined to define an angle through which the link 30 is permitted to swing. The other link 32 also cooperates with a corresponding slit (not shown) similar to that of link 30**.

Both links 30 and 32 in turn are pivoted at their other ends to a receptacle like second link member 34 on pins **30*c* and 32*c*, respectively. The axes of the pins 30*c* and 32*c* are in alignment with each other. As will be understood from FIG. 3, link member 30 cooperates with a slit 30*d* in the wall of member 34 at the upper end of the member 30 while the other link member 32 is pivoted at the upper end thereof to a side face of member 34. As will be seen in FIG. 4, the slit 30*d* has an inclined wall 36 to which abuts the link 30 so that member 34 is held in the position shown. In this position, the member 34 in turn has an edge 38 thereof in abutment with a wall 40 of base 12 so that the position shown of the link 30 and member 34 is ensured under influence of gravity. A supplemental base 42 is pivoted to member 34 at the other edge thereof on pins 44 and 46 (FIG. 3) the axes of which are in alignment with each other. The supplemental base 42 is of a generally L-shaped contour to accomodate a part of periphery of the main base 12 when the sewing machine 10** is in an ordinary mode of operation adapted to ordinary flat fabric. Such mode of operation may hereinafter be termed an "ordinary mode".

Figure 2:
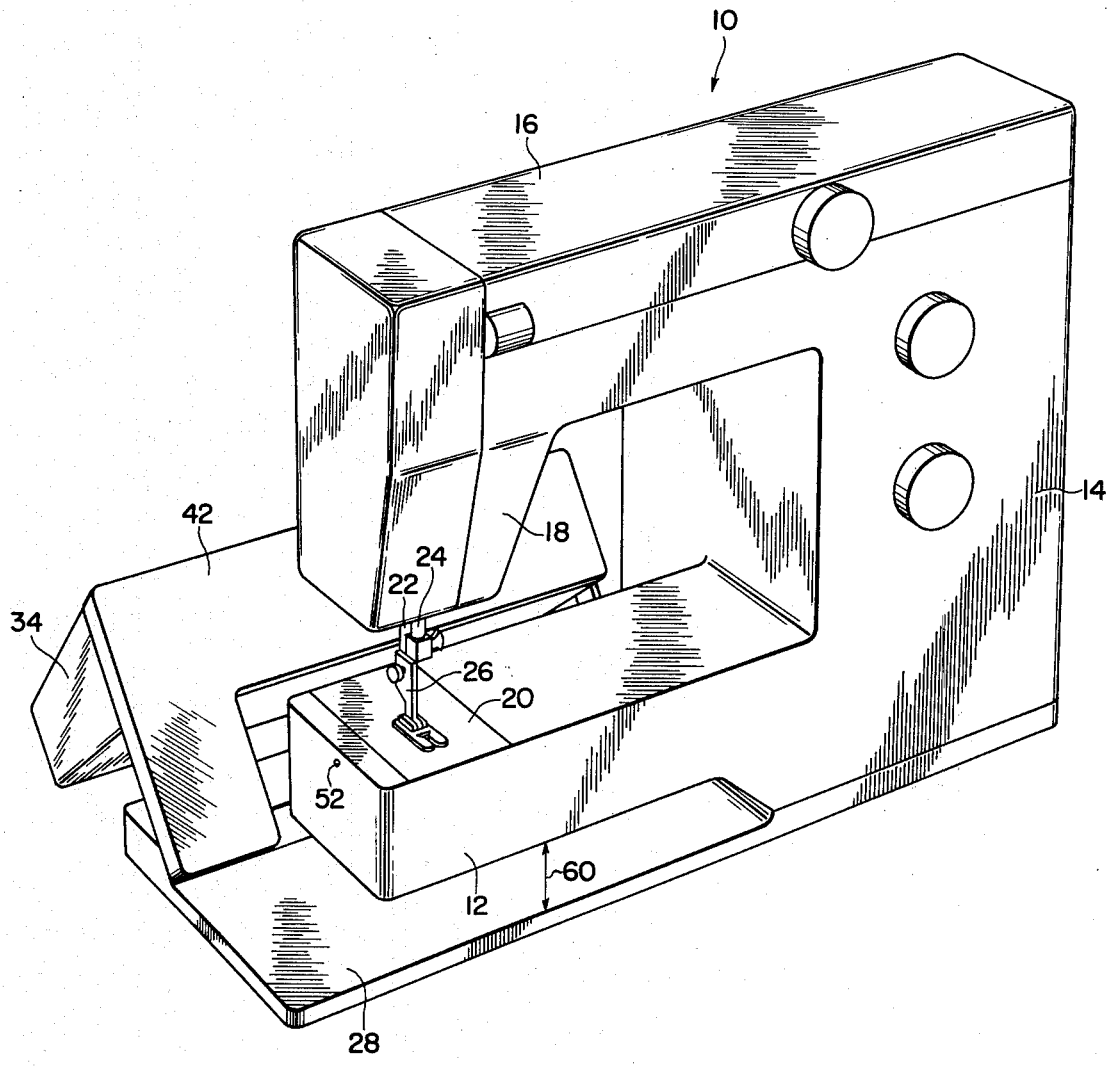
FIG. 2 is a similar view to that of FIG. 1 showing a different mode of operation from that shown in FIG. 1.
Figure 4:
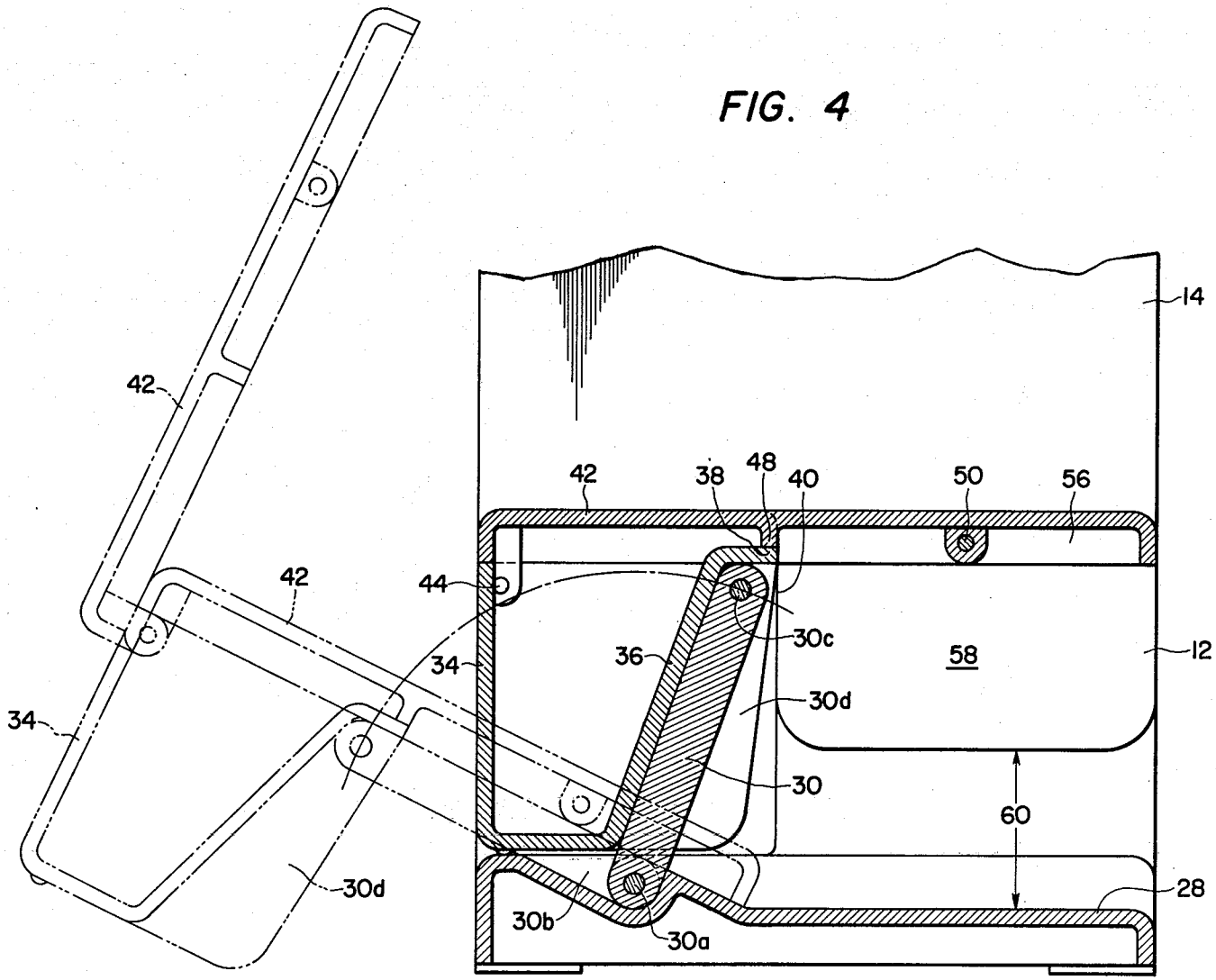
FIG. 4 is a cross sectional view taken along the line IV—IV in FIG. 1.

The supplemental base 42 is provided with a rib 48 in the back face thereof as shown in FIG. 4. The rib 48 abuts the edge 38 of the member 34 in the position shown for strictly holding the supplemental base 42 in a horizontal plane in which lies the main base 12. The supplemental base 42 is further provided with means for locking therof in the position shown in FIG. 4 in solid lines. The locking means may be of an ordinary male-and-female resilient locking type. One half of the locking means shown at 50 in FIG. 4 is in the rib of the supplemental base 42 and the other half shown at 52 in FIG. 2 is in a side face of the base 12. The locking means serves to prevent the supplemental base from being unintentionally opened during the ordinary mode.

The ordinary mode is shown in FIG. 4 in full lines. Another mode of operation, shown in double dot-and-dash lines, may hereinafter be referred to as "tube sewing mode" is provided by swinging the links 30 and 32 until the links abut the inclined bottoms of the slits **30*b*** and 32*b* respectively. In the tube sewing mode, the supplemental base 42 may be swung as shown in single dot-and-dash lines to thereby open the receptacle 34 for ingress and egress of the tools and the like. As shown in FIG. 2, the machine 10 in tube sewing mode is in condition for readily sewing the fabric into tubular form such as, for example, trousers.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A sewing machine comprising:

a main base;

a base plate vertically separated from said main base;

a head extending from the main base, a needle plate associated with the main base for supporting work fabric in position to be stitched, a line extending between said needle plate and said head, in the plane of said needle plate, defining a first direction, a supplemental base connected to the main base through means of link mechanisms placed in a position in which the supplemental base is substantially in a plane including the main base and is immediately contiguous to the main base to present a continuously combined wider flat plane or placed in another position in which the supplemental base is substantially apart from the main base so that the main base is left alone and adapted to support a tubular fabric therearound wherein, said link mechanisms include a pair of parallel and identical length first links separated from one another in said first direction and each pivoted at one end thereof to the base plate for rotation in a plane perpendicular to said first direction, and a second link to which in turn are pivoted said first links at the other ends thereof, said supplemental base being pivotally mounted to the second link, said second link includes an edge portion in abutment with the main base and a wall in abutment with the length of one of the first links to cooperate under influence of gravity with the supplemental base so as to support the supplemental base on the second link in a plane in which lies the main base.

2. A sewing machine as set forth in claim 1, further comprising:

a male-and-female resilient locking member including a male or female half of the male-and-female resilient locking member positioned in the supplemental base and with the other half positioned in the main base.

3. A sewing machine as set forth in claim 2, the second link including a receptacle in an unused space of the sewing machine.

* * * * *

UNITED STATES PATENT AND TRADEMARK OFFICE

CERTIFICATE OF CORRECTION

PATENT NO. : 4,314,517

DATED : Feb. 9, 1982

INVENTOR(S) : Takahiko Kasahara, et. al.

It is certified that error appears in the above—identified patent and that said Letters Patent is hereby corrected as shown below:

Please correct the Priority Data to read as follows:

[30]--- Foreign Application Priority Data

Jan. 13, 1978 [JP] Japan ..... 53-2472[U]

Signed and Sealed this

*Twentieth* Day of *April 1982*

[SEAL]

*Attest:*

GERALD J. MOSSINGHOFF

*Attesting Officer*

*Commissioner of Patents and Trademarks*